United States Patent [19]

Samuelson et al.

[11] Patent Number: 4,630,765

[45] Date of Patent: Dec. 23, 1986

[54] DISPENSER FOR TAPE WITH A STRETCHABLE BACKING

[75] Inventors: Bruce E. Samuelson, West Lakeland Township, Washington County; John T. Rueb, St. Paul, both of Minn.

[73] Assignee: Minnesota Minning and Manufacturing Company, St. Paul, Minn.

[21] Appl. No.: 736,254

[22] Filed: May 22, 1985

[51] Int. Cl.[4] ..... B65D 85/672

[52] U.S. Cl. ..... 225/96; 83/610; 83/649; 225/26; 225/43

[58] Field of Search ..... 83/610, 649; 225/43, 225/26, 96

[56] References Cited

U.S. PATENT DOCUMENTS

| | | | |
|---|---|---|---|
| 2,862,676 | 12/1958 | Castelli | 83/649 X |
| 2,864,446 | 12/1958 | Olson et al. | 83/649 X |
| 3,050,853 | 8/1962 | Domeny | 83/649 X |
| 3,762,261 | 10/1973 | Ekenberg | 225/43 X |

FOREIGN PATENT DOCUMENTS

| | | | |
|---|---|---|---|
| 750625 | 6/1956 | United Kingdom | 225/26 |
| 1256441 | 12/1971 | United Kingdom | 83/649 |

*Primary Examiner*—Frank T. Yost

*Attorney, Agent, or Firm*—Donald M. Sell; James A. Smith; William L. Huebsch

[57] ABSTRACT

A tape dispenser for pressure sensitive adhesive coated tape having a stretchable backing. The dispenser includes a housing comprising a base portion having a cavity in which a roll of the tape is mounted, and a slotted land area spaced from the hub against which tape from said roll may be releasably adhered; and a cover portion on the base portion for movement from an open position with teeth on the cover spaced from the slot toward a closed position so that the teeth enter the slot and cut tape on the land area. The cover includes walls defining a socket adapted to receive a portion of a user's thumb so that the user may grasp the dispenser in one hand with his fingers around the base portion and his thumb in the socket and with one hand alone move the cover and base portions between their open and closed positions leaving his other hand free to pull tape from the dispenser.

3 Claims, 7 Drawing Figures

DISPENSER FOR TAPE WITH A STRETCHABLE BACKING

TECHNICAL FIELD

The present invention relates to hand held dispensers from which pressure sensitive adhesive coated tape having a stretchable backing may be dispensed.

BACKGROUND ART

FIGS. 1 and 2 of the drawing illustrate a prior art tape dispenser 10 adapted to be hand held and to be used to dispense pressure sensitive adhesive coated tape 12 having a stretchable backing from a roll 14 of such tape in the dispenser 10. The dispenser 10 includes a housing 18 comprising a base portion 20 including walls defining a cavity 22, a hub 24 transverse of the cavity 22 about which hub 24 the roll 14 of tape 12 is rotatably mounted, and a land area 26 spaced from the hub 24 against which tape 12 from the roll 14 may be releasably adhered. The walls defining the land area 26 define a slot 28 extending transverse of the land area 26 and providing a portion of the land area 26 on both sides of the slot 28. The dispenser 10 also includes a cover portion 30 having a row of triangular teeth 32 adapted to move into the slot 28 to cut through transversely dispersed portions of the tape 12 adhered on the land area 26, and means in the form of a hinge 34 for mounting the cover portion 30 on the base portion 20 for relative pivotal motion between an open position (FIG. 2) with the teeth 32 spaced from the slot 28 and a closed position (FIG. 1) with the teeth 32 disposed within the slot 28.

The tape 12 with its stretchable backing can be dispensed from this dispenser by moving the cover portion 30 to its open position, manually grasping the end of the tape 12 which is adhered to the portion of the land area 26 closest to the roll 14, and pulling the tape 12 away from the land area 26 and off of the roll 14. When a desired length of the tape 12 has thus been pulled off of the roll 14, the portion of the tape 12 to be severed is adhered to the land area 26 over the slot 28 and the cover portion 30 is moved to its closed position. This causes the teeth 32 to pierce the tape 12 in a plurality of aligned transversely disposed places so that the portion of the tape 12 extending past the teeth 32 can easily manually be torn between the teeth 32 from the tape remaining in the dispenser 10 and simultaneously pulled off of the portion of the land area 26 farthest from the roll 14.

While this dispenser 10 effectively cuts tapes with stretchable backings that cannot easily be cut by pulling it across a serrated cutting edge such as is done on more conventional dispensers, dispensing tape from the dispenser 10 is slow because its use requires a large number of manual manipulations.

SUMMARY OF THE INVENTION

The present invention provides an improvement in a dispenser of the type described above for dispensing tape with a stretchable backing that makes it much more convenient to use than the prior art dispenser described above.

In the dispensers according to the present invention the cover portion further includes wall means defining a socket adapted to receive a portion of a user's thumb so that the user may grasp the dispenser in one hand with his fingers around the base portion and his thumb in the socket and with one hand alone move the cover portion between its open and closed positions. Also, preferably, the base portion of the dispenser according to the present invention has a transverse fin on its side opposite the cover portion adapted to be received between adjacent fingers of a user to further facilitate one handed manipulation of the cover and base portions between their open and closed positions.

BRIEF DESCRIPTION OF THE DRAWING

The present invention will be further described with reference to the accompanying drawing wherein like numbers refer to like parts in the several views, and wherein.

DETAILED DESCRIPTION

Figure 1:
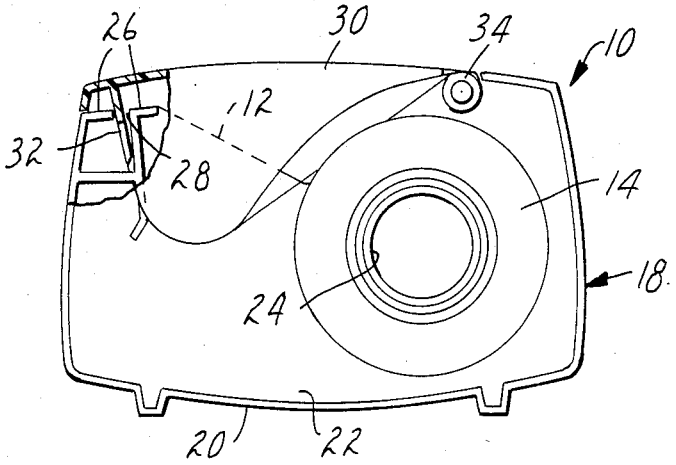
FIG. 1 PRIOR ART
FIGS. 1 and 2 are side views of a prior art tape dispenser from which tape with a stretchable backing may be dispensed shown with a cover portion of the dispenser in a closed and an open position, respectively and having parts broken away to show details.

Referring now to FIGS. 3 through 7 of the drawing, there is shown a tape dispenser according to the present invention generally designated by the reference numeral 50.

Figure 2:
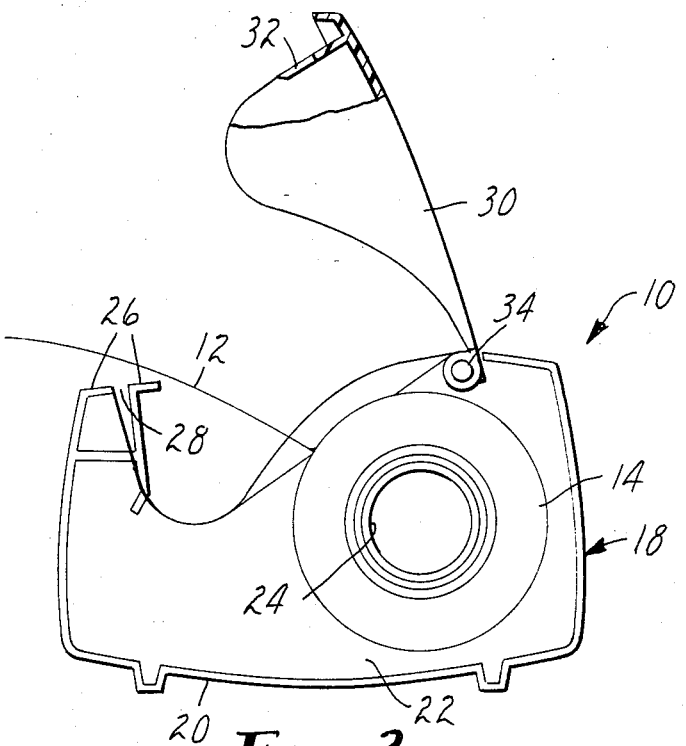
FIG. 2 PRIOR ART

Like the prior art dispenser 10 shown in FIGS. 1 and 2, the dispenser 50 includes a roll 52 of pressure sensitive adhesive coated tape 54 having a stretchable backing from which roll 52 the tape 54 may be dispensed, and a housing 58 comprising a base portion 60 including walls defining a cavity 62, a plurality of arcuate projections 64 (FIG. 4) defining a hub transverse of the cavity 62 about which hub the roll 52 of tape 54 is rotatably mounted, and a land area 66 spaced from the hub 64 against which tape 54 from the roll 52 may be releasably adhered. The walls defining the land area 66 also define a slot 68 extending transverse of the land area 66 and providing a portion of the land area 66 on both sides of the slot 68. The dispenser 50 also includes a cover portion 70 having a row of triangular teeth 72 adapted to move into the slot 68 to cut through transversely disposed portions of the tape 54 adhered on the land area 66, and means in the form of a hinge 74 for mounting the cover portion 70 on the base portion 60 for relative pivotal motion between an open position with the teeth 72 spaced from the slot 68 (FIGS. 3, 6 and 7) and a closed position (FIG. 5) with the teeth 72 disposed within the slot 68.

Unlike the dispenser 10, however, the dispenser 50 is improved in that it further includes wall means in the form of a generally L-shaped wall 76 defining a socket adapted to receive an end portion of a user's thumb so that the user may grasp the dispenser 50 in one hand with his fingers around the base portion 60 and his thumb in the socket (FIG. 3) and with one hand alone move the cover portion 70 between its open and closed positions so that his other hand is free to pull the tape 54 from the roll 52, and pull tape 54 partially cut by closing the cover portion 70 from the dispenser 50.

As can be seen in FIGS. 3 through 7, the housing 58 comprises opposed generally rectangular top and bottom walls 80 and 82, and opposed generally rectangular front and arcuate rear walls 84 and 86, each adjacent different corresponding ends of the top and bottom walls 80 and 82. The top wall 80 is incorporated in the cover portion 70; the front wall 84, the bottom wall 82, and the rear wall 86 are incoroprated in the base portion 60, and the means for mounting or hinge 74 is between the rear wall 86 and the top wall 80. The land area 66 and the opening to the slot 68 are positioned at the end of the front wall 84 adjacent the top wall 80, and the teeth 72 are located at the end of the top wall 80 adjacent the front wall 84. The wall means or L-shaped wall 76 for defining the socket has one part 92 projecting away from the top wall 80 and end wall 84 and a second part 94 projecting along and in spaced relationship (e.g. about 1.3 centimeters or ½ inch spacing) to the top wall 80 so that the top wall 80 and L-shaped wall 76 define the socket therebetween.

Figure 3:
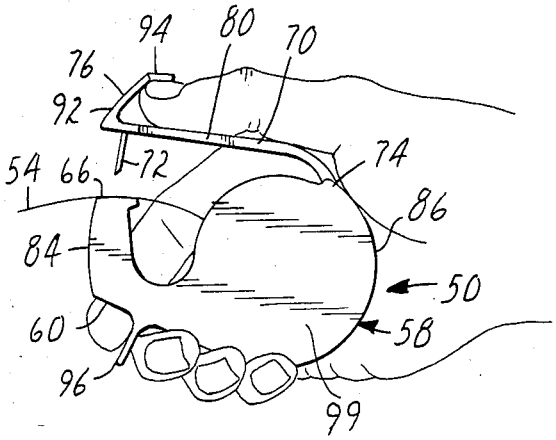
FIG. 3 is a side view of a tape dispenser according to the present invention shown in the hand of a user with a cover portion of the dispenser in an open position.
Figure 4:
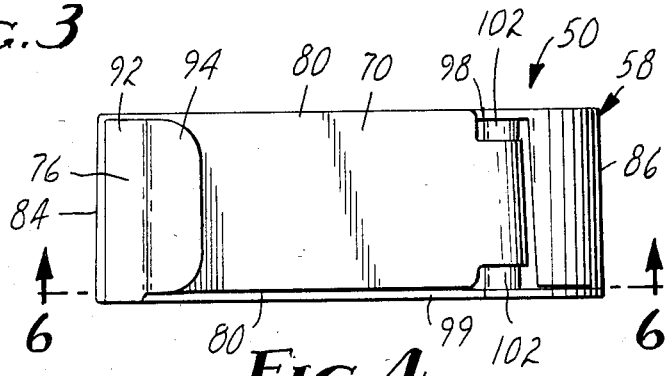
FIG. 4 is an enlarged top view of the tape dispenser of FIG. 3.
Figure 5:
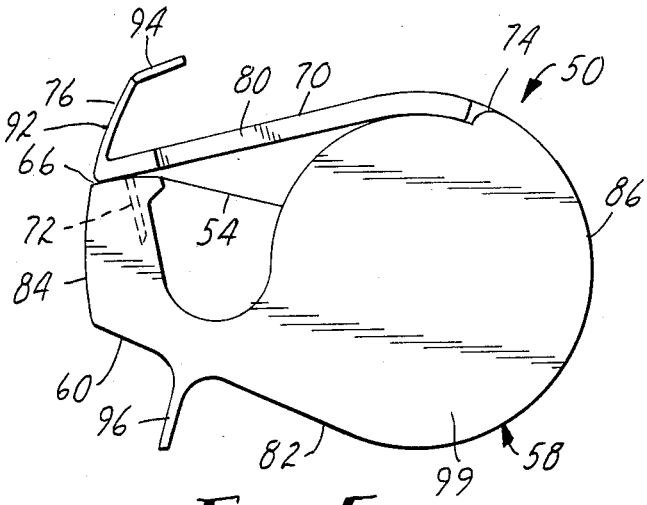
FIG. 5 is an enlarged side view of the tape dispenser of FIG. 3 shown with its cover portion in a closed position.
Figure 6:
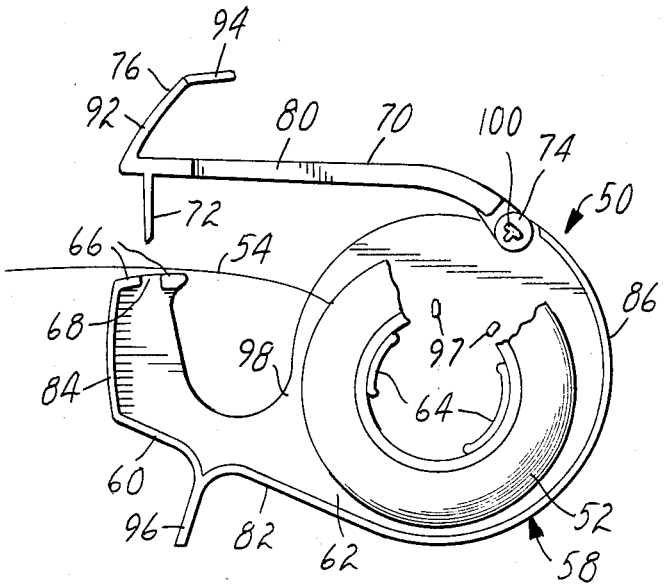
FIG. 6 is a sectional view taken approximately along line 6—6 of FIG. 4 with the cover portion of the dispenser in its open position and having parts broken away to show details.
Figure 7:
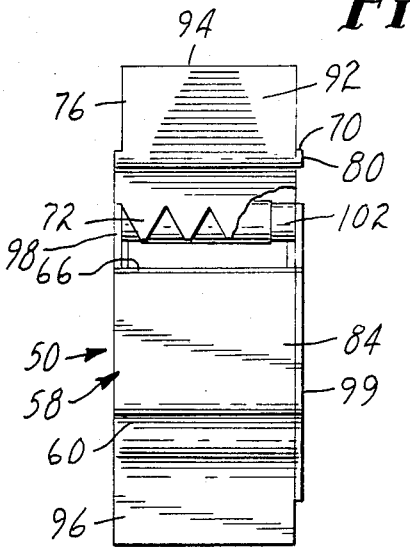
FIG. 7 is an enlarged front view of the tape dispenser of FIG. 3 having parts broken away to show details.

Additionally to further facilitate one handed manipulation of the cover and base portion 70 and 60, the housing 58 preferably includes a transverse fin 96 extending across and projecting at least about 0.6 centimeter or ¼ inch (and preferably about 1.3 centimeter or ½ inch) from the bottom wall 82 in a position generally opposed to the second part 94 of the L-shaped wall 76. As can be seen in FIG. 3, the index and middle fingers of a user's hand can be positioned on opposite sides of the fin 96 to help maintain the location of those fingers during one handed manipulation of the dispenser 50 to move the base and cover portions 60 and 70 between their open and closed positions. The fin 96 also serves as a foot to help support the dispenser 50 when it is rested on a planar surface.

As illustrated, the dispenser 50 is made of three integrally molded parts, including two parts that form the base portion 60 including a first part providing a first side wall 98 from which the front wall 84, the bottom wall 82, the arcuate rear wall 86, and the arcuate projections 64 defining the hub all project at about a right angle together with a plurality of abutments 97 that contact the side surface of the core on which the roll 52 of tape is wound to space it from the side wall and thereby restrict adhesion of the side surface of the roll 52 to the side wall 98; and a second part that provides a second side wall 99 similar in shape to the first side wall 98 that is attached, as by adhesive to the distal ends of the front, bottom, and rear walls 84, 82 and 86 and the arcuate projections 64 opposite the first side wall 98. The third integrally molded part provides the cover portion 70 including the top wall 80, the teeth 72, the L-shaped wall 76, and a generally cylindrical portion across the central part of its end opposite the L-shaped wall 76 from the opposite ends of which project generally T-shaped journals 100 received in sockets in cylindrical portions 102 formed on the side walls 98 and 99 to provide the hinge 74 on which the cover portion 70 pivots relative to the base portion 60.

To dispense the tape 54 with a stretchable backing from the dispenser 50 a user grasps the dispenser 50 as shown in FIG. 1 with his thumb in the socket under the L-shaped wall 76 and his index and middle fingers on opposite sides of the fin 96. The user then lifts his thumb to move the cover portion 70 to its open position, manually grasps the end of the tape 54 which is adhered to the portion of the land area 66 closest to the roll 52 with his other hand, and pulls the tape 54 away from the land area 66 and off of the roll 52. When a desired length of the tape 54 has thus been pulled off of the roll 52, the portion of the tape 54 to be severed is adhered to the land area 66 over the slot 68 and the user lowers his thumb to move the cover portion 70 to its closed position. This causes the teeth 72 to pierce the tape 54 in a plurality of transversely disposed closely adjacent places so that the portion of the tape 54 extending past the teeth 72 can be torn between the teeth 72 from the tape 54 remaining in the dispenser 50 by the user's other hand and simultaneously pulled off of the portion of the land area 66 furthest from the roll 52.

The present invention has now been described with reference to one embodiment thereof. It will be apparent to those skilled in the art that many changes can be made in the embodiment described without departure from the scope of the present invention. For example, the socket could be formed by walls of different shapes. Also, the fin could be positioned to be engaged between different pairs of adjacent fingers. Thus the scope of the present invention should not be limited to the structures described in this application, but only by structures described by the language of the claims and the equivalents of those structures.

We claim:

1. A tape dispenser of the type including a roll of pressure sensitive adhesive coated tape having a stretchable backing; and a housing comprising walls including opposed top and bottom walls, and opposed front and rear walls each intersecting different corresponding ends of said top and bottom walls, said housing including a base portion formed by walls including said front wall, said bottom wall, and said rear wall that define a cavity, walls defining a hub transverse of said cavity about which hub said roll of tape is rotatably mounted, and walls defining a land area spaced from said hub at the end of said front wall adjacent said top wall against which land area tape from said roll may be releasably adhered, the walls defining said land area defining a slot transverse of said land area and providing a portion of said land area on both sides of said slot; said housing also including a cover portion formed by walls including said top wall and having a row of teeth located at the end of said top wall adjacent said front wall adapted to move into said slot to cut through tape adhered on said land area, and means between said rear wall and said top wall for mounting said cover portion on said base portion for relative pivotal motion between an open position with the teeth spaced from the slot and a closed postion with the teeth disposed within the slot; said cover further including a generally L-shaped wall having one part projecting away from said top wall and front wall and a second part projecting along and in spaced relation to said top wall so that said top wall and generally L-shaped wall define a socket therebetween adapted to receive a portion of a user's thumb so that the user may grasp the dispenser in one hand with his fingers around the base portion and his thumb in the socket and with one hand alone move said cover and base portions between said open and closed positions.

2. A dispenser according to claim 1 wherein said base portion has a transverse fin on its side opposite said cover portion adapted to be received between adjacent fingers of a user's hand to facilitate one handed manipulation of said cover and base portions between said open and closed positions.

3. A dispenser according to claim 2 wherein said transverse fin extends transversely across and projects from said bottom wall in a position generally opposed to the second part of said L-shaped wall.

* * * * *